US006036460A

United States Patent [19]

Christ et al.

[11] Patent Number: 6,036,460

[45] Date of Patent: Mar. 14, 2000

[54] FLEXIBLE ARMATURE FOR FUEL INJECTION SYSTEM CONTROL VALVE

[75] Inventors: Wilhem W. Christ, Wyoming; Patrick E. Haney, Paris, both of Mich.

[73] Assignee: Diesel Technology Company, Kentwood, Mich.

[21] Appl. No.: 09/107,194

[22] Filed: Jun. 29, 1998

[51] Int. Cl.[7] ..... F02M 37/04; F02M 51/00

[52] U.S. Cl. ..... 417/505; 251/129.16

[58] Field of Search ..... 417/505; 251/129.16

[56] References Cited

U.S. PATENT DOCUMENTS

| | | | |
|---|---|---|---|
| 4,618,095 | 10/1986 | Spoolstra | 239/90 |
| 4,848,727 | 7/1989 | Nanbu et al. | 251/129.16 |
| 5,191,867 | 3/1993 | Glassey | 123/446 |
| 5,381,965 | 1/1995 | Chabon et al. | 239/585.1 |
| 5,570,842 | 11/1996 | Kindley | 239/585.1 |
| 5,636,615 | 6/1997 | Shorey et al. | 123/506 |
| 5,749,717 | 5/1998 | Straub et al. | 417/505 |

*Primary Examiner*—Charles G. Freay
*Assistant Examiner*—Robert Z. Evora
*Attorney, Agent, or Firm*—Brooks & Kushman P.C.

[57] ABSTRACT

An armature having a middle beam portion connected to an outer body portion flexes during actuation of the control valve so that movement of the control valve relative to the armature outer body portion is damped as the control valve moves to the actuated position. The armature has at least one slot formed at the interface of the middle beam portion and the outer body portion. The at least one slot is configured to allow the armature to flex.

12 Claims, 4 Drawing Sheets

FLEXIBLE ARMATURE FOR FUEL INJECTION SYSTEM CONTROL VALVE

TECHNICAL FIELD

This invention relates to a control valve assembly for damping control valve motion in a heavy duty truck diesel fuel injection system.

BACKGROUND ART

Fuel control valve assemblies in vehicular fuel injection systems typically include a housing having a control valve chamber, a control valve having a piston valve body, and a valve stop. Electromagnetic actuators are commonly used in control valve assemblies for electronically controlling actuation of the control valve. The electromagnetic actuator, usually a solenoid, is enclosed in a stator. The control valve is rigidly secured to an armature. A spring is used to urge the control valve toward a deactuated position which places the armature a short distance away from the stator, and which is usually the open position for the control valve. When the solenoid is energized, the armature is pulled up against the stator, against the spring bias, moving the control valve to the actuated position which is usually the closed position for the control valve. The electromagnetically actuated valve allows greater sophisticated and more precise control over the injection process, thereby improving combustion.

Although fuel pumps and injectors having electromagnetically actuated control valves have been used in many applications that have been commercially successful, control valve bounce limits the ability to control the combustion process in these existing pumps and injectors. Control valve bounce occurs when the armature is pulled up against the stator by the energized solenoid, and the armature bounces upon impact with the stator. The bouncing armature causes the control valve, which is rigidly secured to the armature, to bounce in diminishing series fashion before finally seating. This control valve bounce can significantly lessen the precision of the fuel flow process, and thereby lessen the combustion efficiency.

For the foregoing reasons, there is a need for a control valve assembly for pumps and injectors that overcomes the problems and limitations of the prior art.

DISCLOSURE OF INVENTION

It is, therefore, an object of the present invention to provide pumps and injectors having reduced control valve bounce when the control valve is actuated.

In carrying out the above objects and other objects and features of the present invention, a pump for a fuel injection system is provided. The pump comprises a pump body having a pumping chamber, a fuel inlet for supplying fuel to the pumping chamber, an outlet port, and a control valve chamber between the pumping chamber and the outlet port. A plunger is disposed in the pumping chamber. An actuatable control valve disposed in the control valve chamber controls fuel. The control valve includes a valve body moveable between actuated and deactuated positions.

The pump further comprises a stator assembly including an actuator operable to actuate the control valve, and an armature. The armature has a middle beam portion connected to an outer body portion. The control valve is secured to the middle beam portion. The control valve and the armature are arranged such that operation of the actuator causes the armature to urge the valve body toward the actuated position.

The armature has at least one slot formed at the interface of the middle beam portion and the outer body portion. The at least one slot is configured to allow the armature to flex during actuation of the control valve. The armature flexes to damp movement of the valve body relative to the armature outer body portion as the valve body moves to the actuated position. That is, any bouncing of the armature outer body is damped by the flexing armature, reducing any resulting bouncing of the control valve.

Preferably, the at least one slot includes a pair of parallel slots located on opposite sides of the armature middle beam portion. The control valve is secured to the armature between the pair of slots.

Further, in a preferred embodiment, the armature middle beam portion has a first thickness that is less than a second thickness of the armature outer body portion. Still further, the armature middle beam portion preferably has at least one hole extending therethrough. The hole extends perpendicular to a face of the armature.

Further, in carrying out the present invention, a fuel injector is provided. The fuel injector comprises an injector body with a pumping chamber and a control valve chamber, a plunger, an actuatable control valve, and a stator assembly including an actuator. The injector further comprises an armature having a middle beam portion connected to an outer body portion. The control valve is secured to the middle beam portion; and, the control valve and the armature are arranged such that operation of the actuator causes the armature to urge the valve body toward the actuated position.

The armature has at least one slot formed at the interface of the middle beam portion and the outer body portion. The at least one slot is configured to allow the armature to flex during actuation of the control valve. The armature flexes to damp movement of the valve body relative to the armature outer body portion as the valve body moves to the actuated position. That is, any bouncing of the armature outer body is damped by the flexing armature, reducing any resulting bounce of the control valve.

Still further, in carrying out the present invention, a component for use in a control valve assembly in a fuel injection system is provided. The component comprises an armature having a middle beam portion connected to an outer body portion. The middle beam portion is adapted to secure to an actuable control valve. The armature has at least one slot formed at the interface of the middle beam portion and the outer body portion. The at least one slot is configured to allow the armature to flex during actuation of the control valve to damp movement of the control valve relative to the armature outer body portion as the control valve moves to the actuated position. That is, any bouncing of the armature outer body is damped by the flexing armature, reducing any resulting bounce of the control valve.

The advantages associated with embodiments of the present invention are numerous. For example, armatures made in accordance with the present invention for pumps or injectors may be manufactured as a one-piece armature. The use of a one-piece armature design reduces manufacturing expense, while providing a component that damps control valve bounce when the valve body seats in the actuated position.

The above objects and other objects, features, and advantages of the present invention will be readily appreciated by one of ordinary skill in the art from the following detailed description of the best mode for carrying out the invention when taken in connection with the accompanying drawings.

BEST MODE FOR CARRYING OUT THE INVENTION

Figure 1:
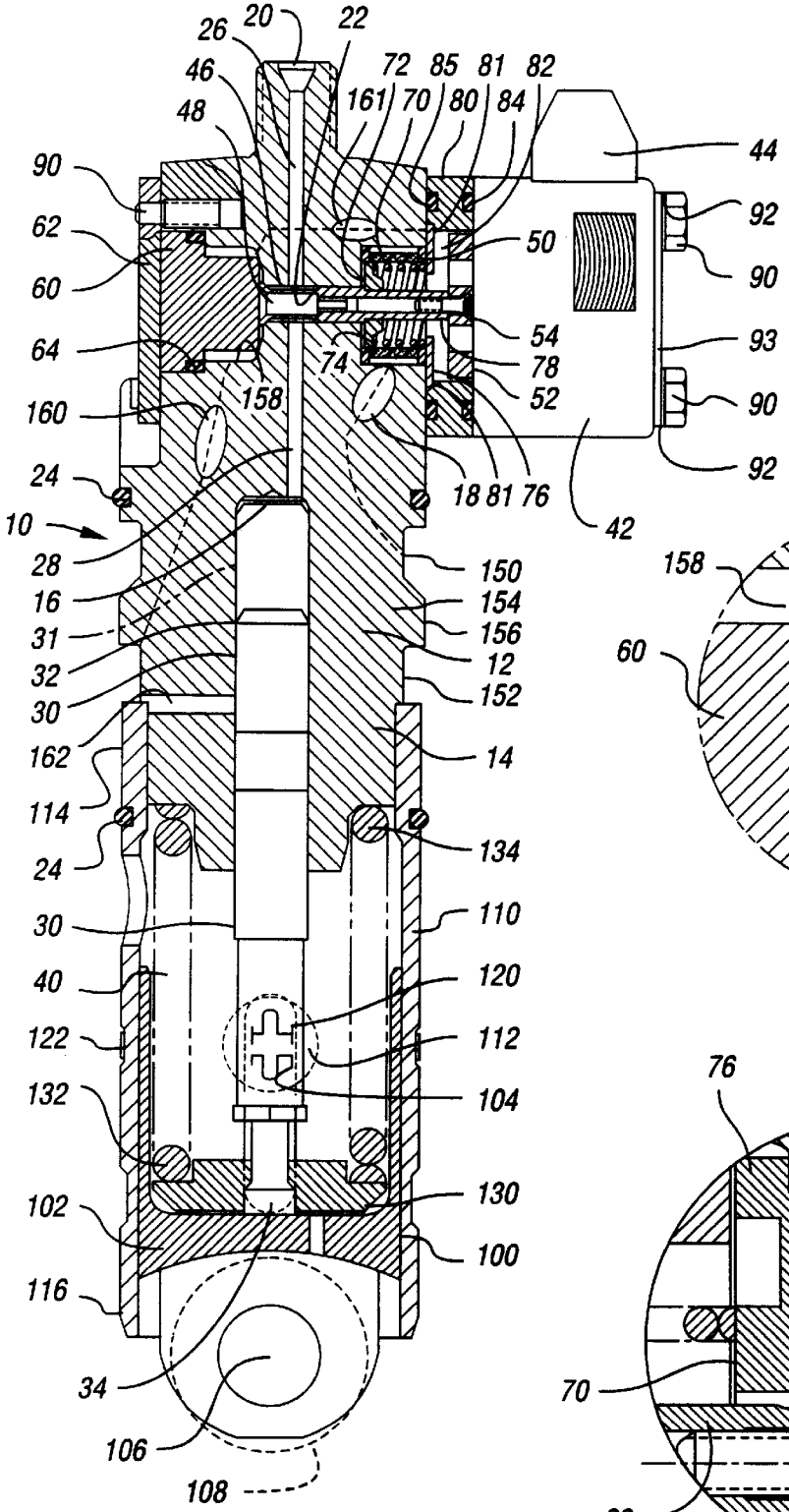
FIG. 1 is a side elevation, in section, of a pump for a fuel injection system made in accordance with the present invention.

Referring to FIG. 1, a pump 10 made in accordance with the present invention is illustrated. The pump 10 has a pump body 12 with a pump body end portion 14. A pumping chamber 16 is defined by pump body 12. A fuel inlet 18 for supplying fuel to pumping chamber 16 is located on the periphery of pump body 12. Pump body 12 further has an outlet port 20, and a control valve chamber 22 between pumping chamber 16 and outlet port 20. O-rings 24 are provided to seal fuel inlet 18 with respect to an engine block which receives pump 10. Passageways 26 and 28 connect outlet port 20, control valve chamber 22, and pumping chamber 16.

A reciprocating plunger 30 is disposed in pumping chamber 16. Plunger 30 has a head end 32 and a tail end 34. Plunger 30 is reciprocatable over a stroke range between a retracted position indicated at 30 and an extended position indicated in phantom at 31. A plunger spring 40 resiliently biases plunger 30 to the retracted position 31.

A stator assembly 42 contains an electromagnetic actuator 44, such as a solenoid, and has terminals for connecting to a power source to provide power for electromagnetic actuator 44. An electromagnetically actuated control valve 46 is disposed in control valve chamber 22 for controlling fuel. Control valve 46 includes a piston valve body 48. Piston valve body 48 is movable between a deactuated position and an actuated position within control valve chamber 22. Typically, the deactuated position is the open position, and the actuated position is the closed position for valve body 48. An annular fuel filter 50 is disposed in pump body 12 about a central axis of piston valve body 48. Fuel inlet 18 allows fuel to pass through fuel filter 50 prior to entering pumping chamber 16. An armature 52 is secured to control valve 46 by a fastener such as a screw 54. A valve stop 60 is disposed in pump body 12 adjacent to control valve chamber 22.

A control valve spring 70 resiliently biases piston valve body 48 into the deactuated position. A control valve spring seat 72 and a control valve spring retainer 76 abut first and second ends 74 and 78 of control valve spring 70, respectively.

A stator spacer 80 having a central opening 82 for receiving armature 52 therein is disposed between pump body 12 and stator assembly 42. Stator spacer 80 has notches 81 for receiving retainer 76. O-rings 84 and 85 seal stator spacer 80 against stator assembly 42 and pump body 12, respectively.

Stop plate 62 has holes in alignment with holes in pump body 12, and holes in stator assembly 42 and stator spacer 80, respectively. Fasteners 90 extend through stator assembly 42, stator spacer 80, and pump body 12. Fasteners 90 secure stop plate 62 against valve stop 60. Preferably, washers 92 are used with fasteners 90, and a nameplate 93 may be secured to stator assembly 42 for identification purposes.

With continuing reference to FIG. 1, a cam follower assembly 100 is illustrated. Cam follower assembly 100 has a housing 102 with an elongated slot 104. Cam follower assembly 100 has an axle 106 and a roller 108 for engagement with a camshaft (not shown). Plunger 30 is reciprocated within pumping chamber 16 between the extended position 31 and the retracted position 30 by cam follower assembly 100. A cylindrical sleeve 110 has an aperture 112 in communication with elongated slot 104. Cylindrical sleeve 110 has first and second end portions 114 and 116, respectively. Pump body end portion 14 interf its with first end portion 114 of cylindrical sleeve 110.

Second end portion 116 of cylindrical sleeve 110 relatively reciprocatably interfits with cam follower assembly 100 for allowing cam follower assembly 100 to drive plunger 30. Cam follower assembly 100 reciprocates within cylindrical sleeve 110 and drives plunger 30 relative to cylindrical sleeve 110 over the stroke range. Preferably, a retainer guide 120 extends through aperture 112, cylindrical sleeve 110, and engages slots 104 in cam follower assembly 100. A clip 122 retains guide 120 within aperture 112.

A plunger spring seat 130 is received in housing 102 of cam follower assembly 100. Plunger spring seat 130 abuts a first end 132 of plunger spring 40. Pump body end portion 14 abuts second end 134 of plunger spring 40.

Pump body 12 has a first annulus 150 in communication with fuel inlet 18 for supplying fuel to the pumping chamber 16. Pump body 12 further has a second annulus 152 in communication with pumping chamber 16 for receiving excess fuel therefrom. An annular belt 154 having outer surface 156 separates first and second annuli 150 and 152, respectively.

An excess fuel chamber 158 receives excess fuel from control valve chamber 22. A conventional fuel equalizing passage 161 provides fuel communication between excess fuel chamber 158 and the control valve and spring chambers. O-ring 64 seals excess fuel chamber 158 with valve stop 60. A return passageway 160 connects excess fuel chamber 158 to second annulus 152. Another return passageway 162 connects pumping chamber 16 to second annulus 152 for receiving any fuel that leaks between plunger 30 and pump body 12. Second annulus 152 is defined by annular belt 154 and first end portion 114 of cylindrical sleeve 110. As well known in the art, fuel is supplied to pump 10 through internal fuel passageways in the engine block (not shown).

Figure 2:
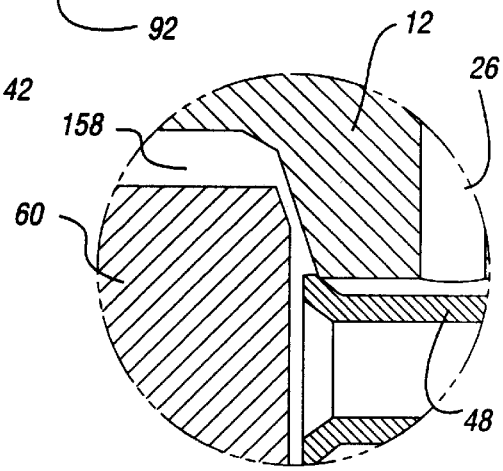
FIG. 2 is an enlarged cross-sectional view of the control valve on the pump shown in FIG. 1.

With reference now to FIG. 2, piston valve body 48 is shown in the unactuated position. Upon actuation, piston valve body 48 is urged inwardly from the open position against valve stop 60 (not specifically shown) to the closed position depicted in FIG. 2. Fuel is allowed to flow through passageway 26 in pump body 12 toward outlet port 20 in accordance with control valve 46 being opened and closed in a fixed sequence allowing the desired fuel pressure to be developed while closed. Passageway 26 is always open to the pumping chamber but fuel flow to the nozzle is precluded, as described, and optionally with the assist of a pressure relief valve (not shown) within the high pressure line, pursuant to conventional practice. It is to be appreciated that embodiments of the present invention may alternatively be configured with as inwardly opening control valve, as opposed to the inwardly closing design depicted in FIG. 1. That is, flex armatures of the present invention damp valve bounce that occurs when the armature is pulled to the stator by the energized solenoid. As such, the control valve may be configured to be either opened or closed in the actuated position, with the flex armature damping valve bounce as the valve seats in its actuated position.

Figure 3:
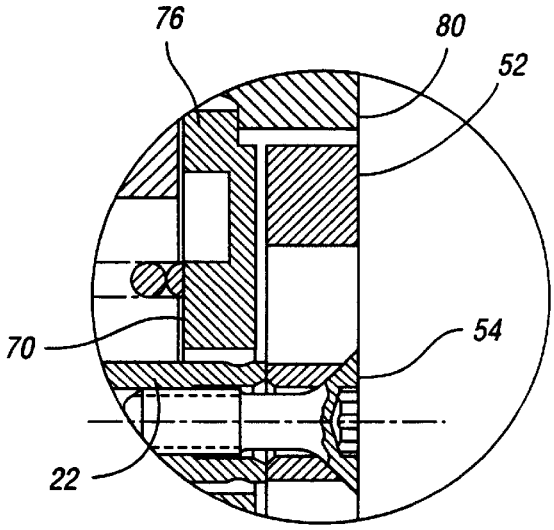
FIG. 3 is an enlarged cross-sectional view of the armature environment on the pump shown in FIG. 1.

With reference to FIG. 3, armature 52 is secured to control valve 46 by screw 54.

Operation of pump 10 will now be described with reference to FIG. 1. Fuel is received from a fuel supply by first annulus 150 and supplied to fuel inlet 18. Fuel inlet 18 routes fuel through fuel filter 50 and to pumping chamber 16. The camshaft (not shown) drives cam follower assembly 100. Plunger 30 is moved from the retracted position 30 to the extended position 31, and fuel is pressurized within pumping chamber 16 when control valve 46 is held closed. Armature 52 flexes upon control valve actuation to damp control valve bounce during valve closing, or in the alternative, during valve opening (not specifically illustrated).

Figure 4:
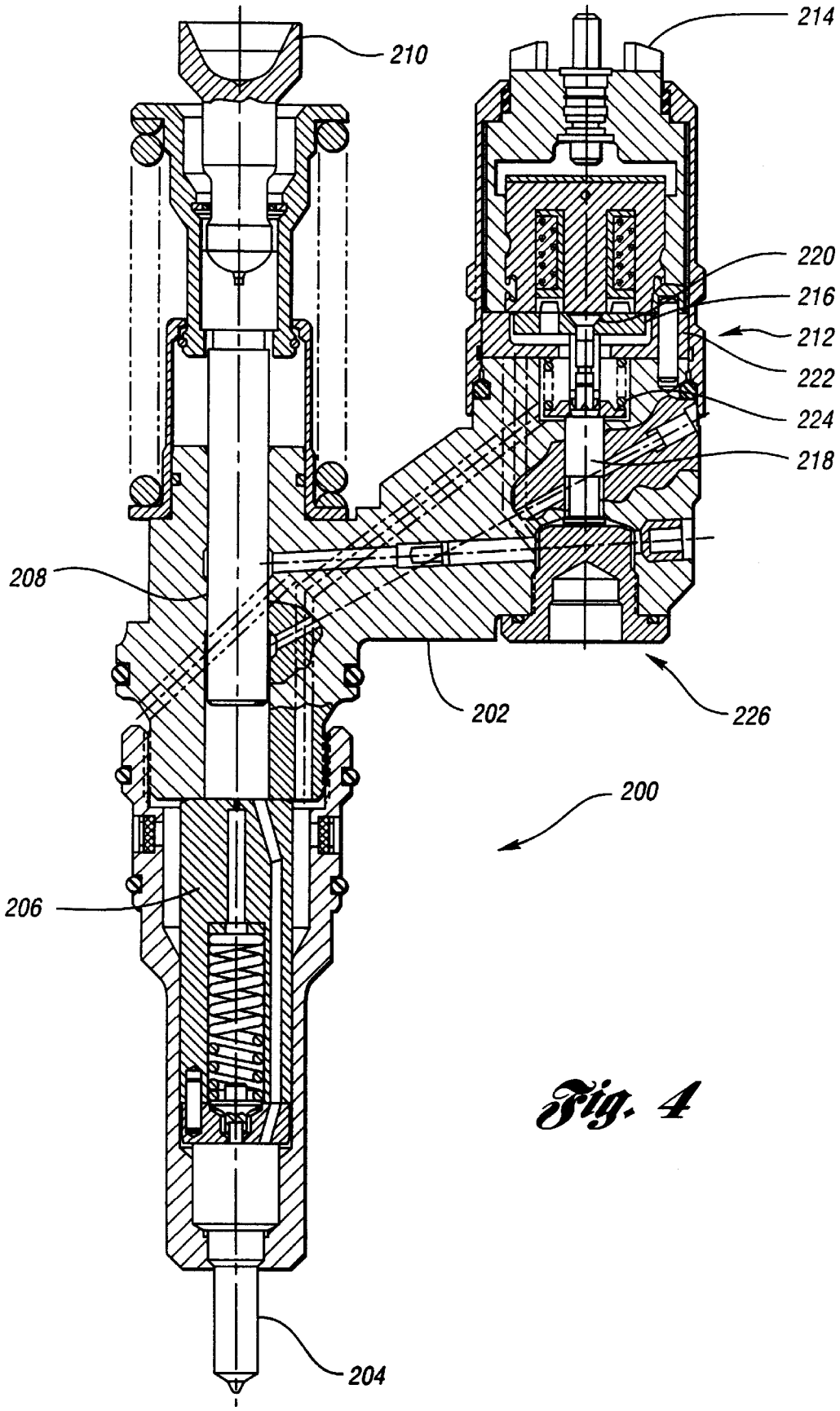
FIG. 4 is a side elevation, in section, of an injector for a fuel injection system made in accordance with the present invention.
Figure 5:
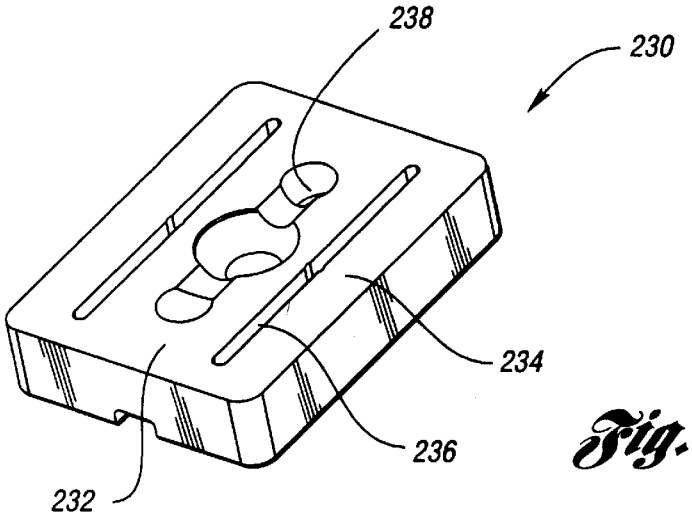
FIG. 5 is a top perspective view of an armature of the present invention.

Referring to FIG. 4, an injector 200 made in accordance with the present invention is illustrated. Injector 200 has an injector body 202 and a nozzle assembly 204. Spring cage assembly 206 is located adjacent nozzle assembly 204. A plunger 208 is reciprocatably driven within body 202 by a push rod 210. A stator 214 includes an actuator for controlling an electronically controlled valve assembly 212. A flex armature 216 of the present invention is secured to a control valve 218 by an armature screw 220. Armature 216 is encircled by a stator spacer 222. Control valve 218 is biased toward a deactuated position by control valve spring 224. Upon actuation, armature 216 is pulled toward stator 214 resulting in control valve 218 moving against the bias of spring 224 into the actuated position. Armature 216 flexes to damp control valve bounce when control 218 moves into and seats in the actuated position.

Injector 200 operates in a known manner, as shown, for example, in U.S. Pat. No. 4,618,095, assigned to the assignee of the present invention, and hereby incorporated by reference in its entirety. Similar to pump 10 (FIG. 1), control valve assembly 212 may be configured to either open or close upon valve actuation, based on the particular pump or injector design.

Flex armature 52 of pump 10 (FIG. 1), and flex armature 216 of injector 200 (FIG. 4), are configured in accordance with the present invention to damp valve bounce during valve actuation. A preferred embodiment of a flex armature of the present invention is depicted in FIGS. 5–11, where the armature is generally indicated at 230. Referring to FIGS. 5–11, and as best shown in the perspective views of FIGS. 5 and 6, armature 230 has a middle beam portion 232 connected to an outer body portion 234. Armature 230 has at least one slot 236, and preferably a pair of parallel slots 236, formed at the interface of middle beam portion 232 and outer body portion 234. In a preferred embodiment, the pair of parallel slots 236 are located on opposite sides of armature middle beam portion 232. The at least one slot, but preferably pair of parallel slots 236, are configured to allow armature 230 to flex during actuation of the control valve.

The control valve is secured to middle beam portion 232, as shown in pump 10 (FIGS. 1, 3) and injector 200 (FIG. 4). Operation of the actuator causes armature 230 to urge the control valve toward the actuated position, by pulling armature 230 toward the stator.

The forces on armature 230 act primarily on outer body portion 234, allowing middle beam portion 232 to flex during actuation of the control valve. Thus, movement of the control valve relative to armature outer body portion 234 is damped as the control valve moves to the actuated position.

Figure 6:
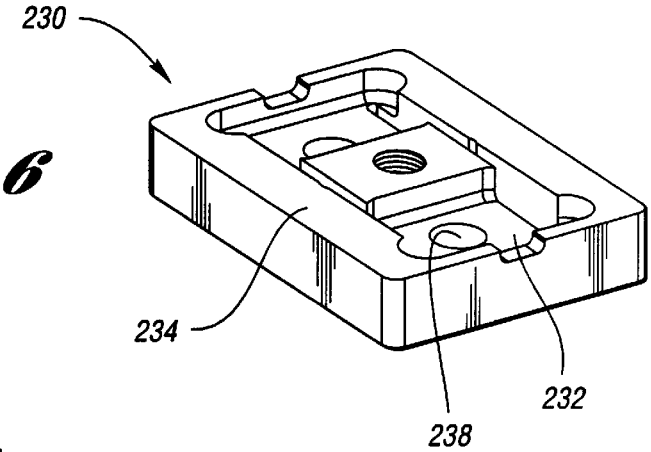
FIG. 6 is a bottom perspective view of the armature shown in FIG. 5.
Figure 7:
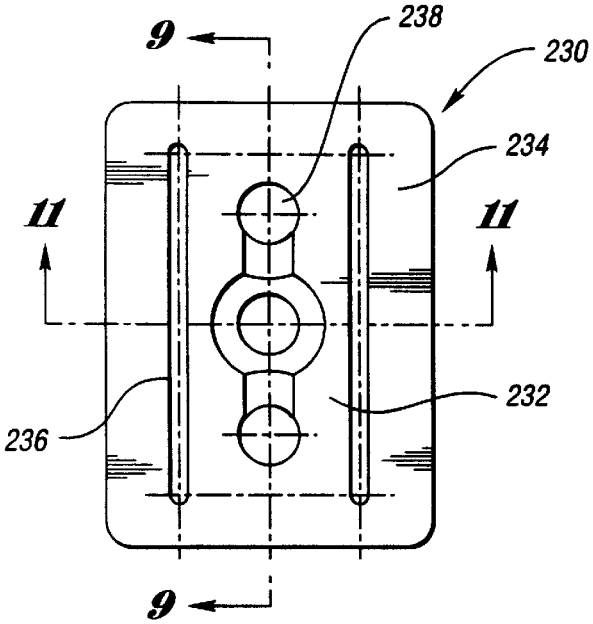
FIG. 7 is a top view of the armature shown in FIG. 5.
Figure 8:
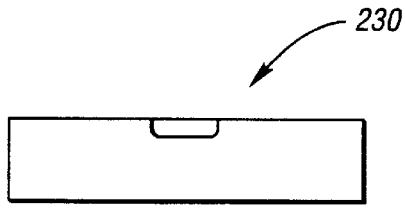
FIG. 8 is an end view of the armature shown in FIG. 5.
Figure 9:
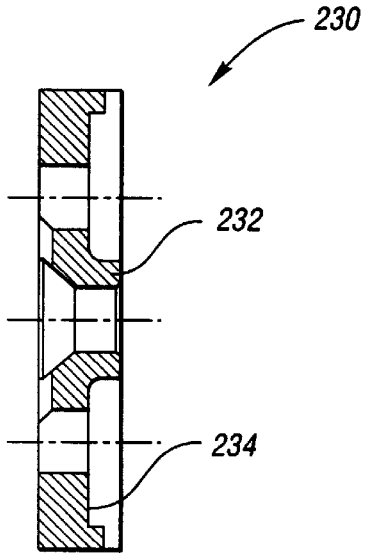
FIG. 9 is a cross-sectional view taken along line 9—9 of Fig, 7.
Figure 10:
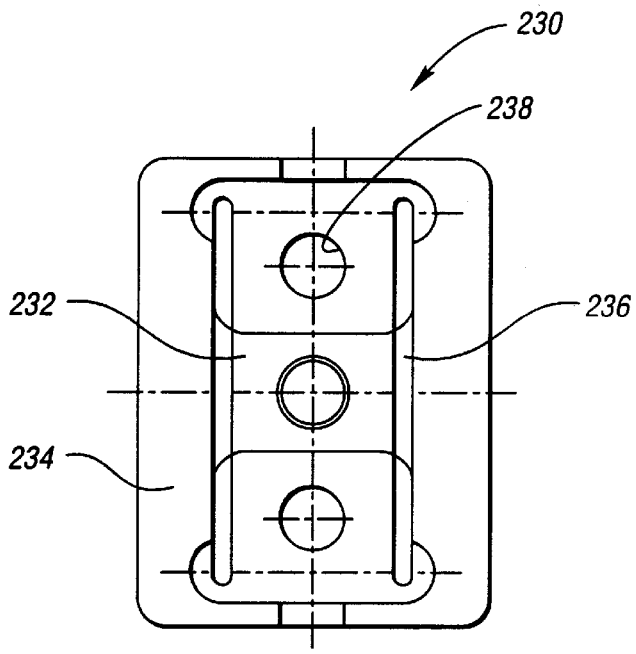
FIG. 10 is a bottom view of the armature shown in FIG. 5.
Figure 11:
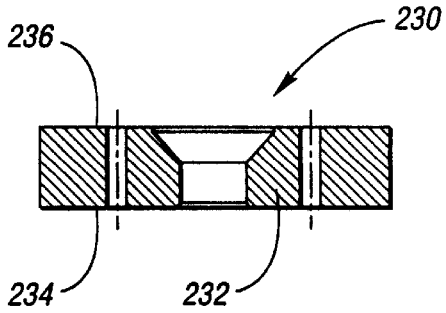
FIG. 11 is a cross-sectional view taken along line 11—11 of FIG. 7.

In a preferred embodiment, armature middle beam portion 232 has a first thickness that is less than a second thickness of armature outer body portion 234, as best shown in FIG. 6. Substantially all of middle beam portion 232 is thin with the exception of the point of attachment to the control valve. The thinned middle beam portion 232 facilitates flexing of armature 230.

Further, in a preferred embodiment, armature middle beam portion 232 has at least one hole, and preferably a pair of holes 238 extending perpendicular to a face of the armature. Holes 238 allow fluid flow therethrough when armature 230 is immersed in a fluid filled chamber. Holes 232 have been found to help reduce cavitation of armature 230.

It is to be appreciated that there are many configurations for middle beam portion 232 and outer body portion 234 interfacing each other with at least one slot that allow armature 230 to flex. The flexing armature is constructed to damp the effects of any bouncing of armature outer body 234, reducing any resulting bounce of the control valve.

Further it is to be appreciated that the flex armature, in a preferred embodiment, isolates the movement of the control valve from the armature by the flexible beam that has been cut in the middle of the armature. Attaching the valve to the middle of the beam helps minimize valve bounce created when the control valve is closed (in an inwardly closing configuration) by the armature being pulled to the stator.

While the best mode for carrying out the invention has been described in detail, those familiar with the art to which this invention relates will recognize various alternative designs and embodiments for practicing the invention as defined by the following claims.

What is claimed is:

1. A pump for a fuel injection system, the pump comprising:

a pump body having a pumping chamber, a fuel inlet for supplying fuel to the pumping chamber, an outlet port, and a control valve chamber between the pumping chamber and the outlet port;

an actuatable control valve disposed in the control valve chamber for controlling fuel, the control valve including a valve body moveable between actuated and deactuated positions;

a stator assembly including an actuator operable to actuate the control valve; and an armature having a middle beam portion connected to an outer body portion, the control valve being secured to the middle beam portion, and the valve body and the armature being arranged such that operation of the actuator causes the armature to urge the valve body axially toward the actuated position, wherein the middle beam portion has a periphery with a free part and a fixed part that is fixed to the outer body portion, the armature having a slot extending therethrough and located along the periphery free part, the free part having a continuous portion of sufficient length such that the armature flexes at the periphery fixed part and the middle beam portion moves generally axially relative to the outer body portion at the free part along the slot during actuation of the control valve so that movement of the valve body relative to the armature outer body portion is damped as the valve body moves to the actuated position.

2. The pump of claim 1 wherein the slot comprises a pair of parallel slots located on opposite sides of the armature middle beam portion, wherein the control valve is secured to the armature between the pair of slots.

3. The pump of claim 1 wherein the armature middle beam portion has a first thickness that is less than a second thickness of the armature outer body portion.

4. The pump of claim 1 wherein the armature middle beam portion has at least one hole extending therethrough, the hole extending perpendicular to a face of the armature.

5. A fuel injector comprising:

an injector body having a pumping chamber, and a control valve chamber;

an actuatable control valve disposed in the control valve chamber for controlling fuel, the control valve including a valve body moveable between actuated and deactuated positions;

a stator assembly including an actuator operable to actuate the control valve; and an armature having a middle beam portion connected to an outer body portion, the valve body being secured to the middle beam portion, and the control valve and the armature being arranged such that operation of the actuator causes the armature to urge the valve body axially toward the actuated position, wherein the middle beam portion has a periphery with a free part and a fixed part that is fixed to the outer body portion, the armature having a slot extending therethrough and located along the periphery free part, the free part having a continuous portion of sufficient length such that the armature flexes at the periphery fixed part and the middle beam portion moves generally axially relative to the outer body portion of the free part along the slot during actuation of the control valve so that movement of the valve body relative to the armature outer body portion is damped as the valve body moves to the actuated position.

6. The injector of claim 5 wherein the slot comprises a pair of parallel slots located on opposite sides of the armature middle beam portion, wherein the control valve is secured to the armature between the pair of slots.

7. The injector of claim 5 wherein the armature middle beam portion has a first thickness that is less than a second thickness of the armature outer body portion.

8. The injector of claim 5 wherein the armature middle beam portion has at least one hole extending therethrough, the hole extending perpendicular to a face of the armature.

9. A component for use in a control valve assembly in a fuel injection system, the component comprising:

an armature having a middle beam portion connected to an outer body portion, the middle beam portion being adapted to secure to an actuatable control valve, wherein the middle beam portion has a periphery with a free part and a fixed part that is fixed to the outer body portion, the armature having a slot extending therethrough and located along the periphery free part, the free part having a continuous portion of sufficient length such that the armature flexes at the periphery fixed part and the middle beam portion moves generally axially relative to the outer body portion of the free part along the slot during actuation of the control valve so that movement of the control valve relative to the armature outer body portion is damped as the control valve moves to an actuated position.

10. The component of claim 9 wherein the slot comprises a pair of parallel slots located on opposite sides of the armature middle beam portion.

11. The component of claim 9 wherein the armature middle beam portion has a first thickness that is less than a second thickness of the armature outer body portion.

12. The component of claim 9 wherein the armature middle beam portion has at least one hole extending therethrough, the hole extending perpendicular to a face of the armature.

* * * * *